United States Patent [19]

Schermerhorn

[11] 3,958,233

[45] May 18, 1976

[54] MULTIPHASE DATA SHIFT DEVICE

[75] Inventor: Jerry D. Schermerhorn, Swanton, Ohio

[73] Assignee: Owens-Illinois, Inc., Toledo, Ohio

[22] Filed: July 31, 1974

[21] Appl. No.: 493,366

[52] U.S. Cl. ..... 340/324 M; 315/169 TV; 340/166 EL; 340/173 PL

[51] Int. Cl.[2] ..... G08B 5/36

[58] Field of Search ..... 315/169 R, 169 TV; 340/324 M, 173 PL, 166 EL

[56] References Cited

UNITED STATES PATENTS

| | | | |
|---|---|---|---|
| 3,701,924 | 10/1972 | Glaser | 315/169 R |
| 3,795,908 | 3/1974 | McDowell et al. | 315/169 R |
| 3,839,713 | 10/1974 | Urade et al. | 315/169 TV |
| 3,839,715 | 10/1974 | Andoh et al. | 340/324 M |
| 3,846,669 | 11/1974 | Glaser et al. | 315/169 R |
| 3,878,430 | 4/1975 | Hirose | 340/324 M |
| 3,881,129 | 4/1975 | Nakayama et al. | 315/169 TV |
| 3,895,361 | 7/1975 | Jones et al. | 340/324 M |
| 3,909,665 | 9/1975 | Andoh et al. | 315/169 TV |

*Primary Examiner*—David L. Trafton
*Attorney, Agent, or Firm*—Donald Keith Wedding

[57] ABSTRACT

There is disclosed an improved display and data shift system for gaseous discharge display panels having wall charge memory properties. The principle of discharge logic is combined with a multiphase voltage system for shifting information transferred to the panel.

28 Claims, 16 Drawing Figures

4th GROUP
3rd GROUP
2nd GROUP
1st GROUP
WAVEFORM ON CONDUCTORS
3C 2C 1C 3C 2C 1C 3C 2C 1C 3C 2C 1C T P C
WAVEFORM PHASE
TIME INTERVAL
INITIAL STATE ALONG CONDUCTOR Hi
56
57
58
TRANSFER AND SHIFT LEFT O WAVEFORM ON Y
S
DT
DT
φ1
φ1
φ2
φ2
φ3
φ3
-t0-t1
t1-t2
t2-t3
t3-t4
t4-t5
T P C
AFTER TRANSFERRING AND SHIFTING LEFT
SHIFT LEFT D OR S WAVEFORM
t5-t6
t6-t7
t7-t8
SHIFTED LEFT

MULTIPHASE DATA SHIFT DEVICE

BACKGROUND OF THE INVENTION

The technique of introducing information at one end of a gas discharge display device as a pattern of on or off states at discrete discharge sites and shifting such information to a selected display position within the device is known in the art. In one known system, information is entered to a first vertical electrode and a system of multiphased voltages is applied to succeeding sets of vertical electrodes of the display device to shift data laterally therein. In such case there is only one information light spot on at a time. Other systems use auxiliary intermediate electrodes (reference Andoh et al U.S. Pat. No. 3,801,851), the voltage amplitude and polarity being selected to vary the size of the discharge spot for shifting purposes. Other data shift systems depend on different dielectric thicknesses or dielectric constants of two opposed dielectric layers (reference Andoh et al U.S. Pat. NO. 3,803,440). In still another prior display data shifting system, the wall voltage produced at one site is used to initiate a discharge, having a longer path length, between one site and a next adjacent site (reference McDowell et al U.S. Pat. No. 3,795,908). The longer path length reduces the operating margins and requires use of the wall charge mechanism to effect lateral transfer of information. Finally, in still another prior art system, tapered and similarly shaped electrodes are used for assuring an overlap of the wall charge of one site with an adjacent one for transfer purposes (reference German Offenlegungsschrift No. 2,130,706). Other shift register devices and techniques are disclosed by U.S. Pat. Nos. 3,775,764 (Gaur) and 3,789,264 (Janning).

In accordance with the practice of this invention, the principle of discharge logic is combined with a multiphase data shift to provide improved display system in a multiple gas discharge display/memory device.

Multiple gas discharge display and/or memory panels of the type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to be physically isolated relative to other cells. In either case, with or without the confining physical structure, charges (electrons, ions) produced upon ionization of the elemental gas volume of a selected discharge cell, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically-isolated or open discharge cells is disclosed in U.S. Pat. No. 3,499,167 issued to Theodore C. Baker, et al.

An example of a panel containing physically isolated cells is disclosed in the article by D. L. Bitzer and H. G. Slottow entitled "The Plasma Display Panel—A Digitally Addressable Display With Inherent Memory", Proceeding of the Fall Joint Computer Conference, IEEE, San Francisco, California, Nov. 1966, pp. 541–547. Also reference is made to U.S. Pat. No. 3,559,190.

In the construction of the panel, a continuous volume of ionizable gas is confined between a pair of dielectric surfaces backed by conductor arrays typically forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental discharge cells will be the product $H \times C$ and the number of elemental or discrete areas will be twice the number of such elemental discharge cells.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing electrodes, but between two contiguous or adjacent electrodes on the same substrate; the gas being confined between the substrate and an outer retaining wall. Reference is made to U.S. Pat. No. 3,787,106 issued to Schermerhorn.

It is also feasible to have a gas discharge device wherein some of the conductive or electrode members are in direct contact with the gaseous medium and the remaining electrode members are appropriately insulated from such gas, i.e., at least one insulated electrode.

In addition to the matrix configuration, the conductor arrays may be shaped otherwise. Accordingly, while the preferred conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly, i.e., a segmented display.

The gas is one which produces visible light or invisible radiation which stimulates a phosphor (if visual display is an objective) and a copious supply of charges (ions and electrons) during discharge.

In prior art, a wide variety of gases and gas mixtures have been utilized as the gaseous medium in a gas discharge device. Typical of such gases include CO; $CO_2$; halogens; nitrogen; $NH_3$; oxygen; water vapor; hydrogen; hydrocarbons; $P_2O_5$; boron fluoride, acid fumes; $TiCl_4$; air; $H_2O_2$; vapors of sodium, mercury, thallium, cadmium, rubidium, and cesium; carbon disulfide, $H_2S$; deoxygenated air; phosphorus vapors; $C_2H_2$; $CH_4$; naphthalene vapor; anthracene; freon; ethyl alcohol; methylene bromide; heavy hydrogen; sulfur hexafluoride, tritium; radioactive gases; and the rare or inert gases.

In one embodiment, the medium comprises at least one rare gas, more preferably at least two, selected from helium, neon, argon, krypton, or xenon.

In an open cell Baker, et al. type panel, the gas pressure and the electric field are sufficient to laterally confine charges generated on discharge within elemental or discrete dielectric areas within the perimeter of such areas, especially in a panel containing non-isolated discharge cells. As described in the Baker, et al. patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition at least one elemental volume other than the elemental volume in which the photons originated.

With respect to the memory function of a given discharge panel, the allowable distance or spacing between the dielectric surfaces depends, inter alia, on the frequency of the alternating current supply, the distance typically being greater for lower frequencies.

While the prior art does disclose gaseous discharge devices having externally positioned electrodes for initiating a gaseous discharge, sometimes called "electrodeless discharge", such prior art devices utilized frequencies and spacing or discharge volumes and operating pressures such that although discharges are initiated in the gaseous medium, such discharges are ineffective or not utilized for charge generation and storage at higher frequencies; although charge storage may be realized at lower frequencies, such charge storage has not been utilized in a display/memory device in the manner of the Bitzer-Slottow or Baker, et al. invention.

The term "memory margin" is defined herein as $$M.\,M. = \frac{V_f - V_E}{V_f/2}$$

where $V_f$ is the half amplitude of the smallest sustaining voltage signal which results in a discharge every half cycle, but at which the cell is not bi-stable and $V_E$ is the half amplitude of the minimum applied voltage sufficient to sustain discharges once initiated.

It will be understood that the basic electrical phenomenon utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, at least one discharge for each half cycle of applied alternating sustaining voltage, once the elemental gas volume has been fired, to maintain alternate storing of charges at pairs of opposed discrete areas on the dielectric surfaces.

As used herein, a cell is in the "on state" when a quantity of charge is stored in the cell such that on each half cycle of the sustaining voltage, a gaseous discharge is produced. In addition to the sustaining voltage, other voltages may be utilized to operate the panel.

In the operation of a multiple gaseous discharge device, of the type described hereinbefore, it is necessary to condition the discrete elemental gas volume of each discharge cell by supplying at least one free electron thereto such that a gaseous discharge can be initiated when the cell is addressed with an appropriate voltage signal. The prior art has disclosed and practiced various means for conditioning gaseous discharge cells.

One external conditioning method comprises the use of external radiation, such as flooding part or all of the gaseous medium of the panel with ultraviolet radiation. This external conditioning method has the obvious disadvantage that it is not always convenient or possible to provide external radiation to a panel, especially if the panel is in a remote position. Likewise, an external UV source required auxiliary equipment. Accordingly, the use of internal conditioning is generally preferred.

One internal conditioning means comprises using internal radiation, such as by the inclusion of a radioactive material.

For the fabrication, structure, and operation of a multiple gas discharge display/memory device, reference is made to U.S. Pat. Nos. 3,499,167 issued to Baker et al; 3,559,190 issued to Bitzer et al; 3,603,836 issued to Grier; 3,631,287 issued to Hoehn; 3,634,719 issued to Ernsthausen; 3,787,106 issued to Schermerhorn; 3,806,761 issued to Bode et al; 3,701,184 issued to Grier; 3,746,420 issued to Baker et al; 3,823,393 issued to Byrum et al; 3,762,901 issued to Salisbury et al; and 3,749,959 issued to Schmersal et al; all of which patents are hereby incorporated by reference.

THE INVENTION

In accordance with the practice of this invention, there is provided a gas discharge display panel and associated electronic means for applying potential signals to the panel, the gas discharge display panel being characterized by an ionizable gaseous medium and having a pair of opposing conductor arrays transversely oriented so as to define a matrix of gas discharge cells within the gaseous medium in the vicinity of a matrix of conductor crosspoints, the conductors of that least one array being insulated from the gaseous medium by at least one dielectric member, the associated electronic means comprising at least first, second and third potential sources, at least two of the sources being in phase with respect to each other and out of phase with respect to at least one of the remaining sources at any selected instant of time, means connecting a first set of spaced conductors in one of the arrays to the first potential source, means connecting a second set of spaced conductors in said one of the arrays to the second potential source, each conductor of the second set being respectively adjacent to a conductor in the first set of conductors in a one-to-one relationship, means connecting a third set of spaced conductors in said one of the arrays to the third potential source, each conductor of the third set being respectively adjacent to a conductor in the second set of conductors in a one-to-one relationship such that each conductor of the second set is intermediate to both a conductor in the first set and a conductor in the third set, at least one further potential source and means connecting said further potential source to at least one conductor on the other opposing conductor array, the combination of the further potential source and each of at least two of the other potential sources constituting a potential waveform.

a. which causes discharge sequences to occur at adjacent discharge cells near the crosspoint vicinity of adjacent conductors when at least one cell has been in a discharge state in an immediately preceding time interval, or b. which causes no discharge sequence to occur at adjacent discharge cells near the crosspoint vicinity of adjacent conductors when neither cell has been in a discharge state in an immediately preceding time interval in either instance (a) or (b), each said adjacent conductor being connected to potential sources which are substantially in phase, at least one other conductor connected to at least one potential source out of phase with the in phase potential sources of said adjacent conductors, the combination of the further potential source and each out of phase potential source constituting a waveform which prohibits the continuance of a discharge at a cell near the crosspoint vicinity of a conductor connected to the out of phase potential source.

ADVANTAGES OF THIS INVENTION

Some advantages of this invention over the prior art include the following:

1. Improved visual display characteristics having an inherently higher light output, including a wider effective resolution spot for observation by human or machine. In operation, the system drives at least two light dots or matrix crosspoints in the display device for each resolution element. In this regard, the use of a split conductor system for the horizontal conductors instead of two light spots (in a three phase system) will provide four light spots further enhancing the visual display characteristics as well as permitting higher light use efficiency.

2. Ability to selectively shift any line of display material while maintaining others stationary, including the selective movement of the cursor bar(s).

3. Inexpensive circuits.

4. Improved display device operating characteristics.

5. Improved operating range including a wider variation in the magnitude and timing of the voltage sources.

6. Panel conductors (electrodes) may be driven with a special asymmetric waveform.

7. Improved introduction of data entry to the panel.

8. Wider application of display; for example, in addition to alpha-numeric displays, there may be utilized graphic displays such as a time sample scope.

BRIEF DESCRIPTION OF THE DRAWINGS

FIG. 2C illustrates the waveforms for the algebraic differences between the column electrode waveforms and the data shift waveform to the row electrodes of FIG. 2A;

FIG. 3A is a plot of the various voltage waveforms against time as a base as applied to the row and column electrodes of the devices of FIGS. 1A through 1D, differing from FIG. 2A in the degree of phase shift of the several column electrode waveforms and utilizing, in all but the conditioning waveform, column and row components of generally the same magnitude whereby the dwell time at intermediate voltage pedestals of the various composite waveforms enable changes in discharge status obtained with greater magnitudes in FIGS. 2A through 2D;

FIG. 3B corresponds to FIG. 2C for the algebraic difference waveforms of FIG. 3A;

FIG. 6 is a functional block diagram of the logic for actuating the switching means of FIGS. 5A and 5B;

DETAILED DESCRIPTION OF THE PREFERRED EMBODIMENTS

Figure 1A:
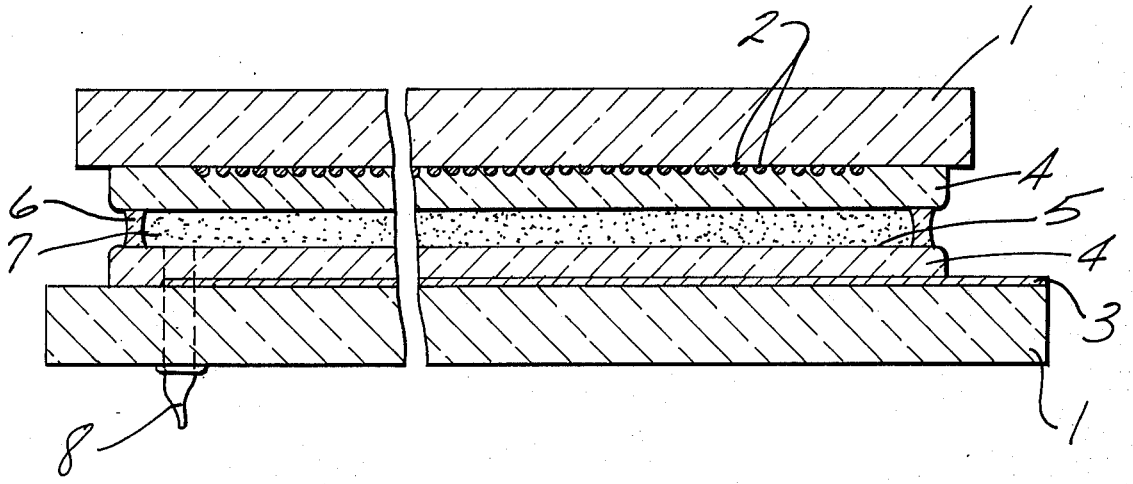
FIG. 1A is a sectioned view of a gaseous discharge display/memory panel taken along the line 1—1 of FIG. 1B.

In FIGS. 1A, 1B, 1C, and 1D, there is illustrated the electrode geometry of a data shiftable plasma display panel. The x axes conductors 2 are connected in groups of three V1, V2, V3 to be used in a three operational phase or mode shift sequence. Also provided are x axes conductors P, C and T to be discussed hereinafter. The y axes contains any desired number of conductors 3, which may be split, solid, or transparent, and/or take on a variety of shapes. The conductors are applied to a base substrate 1 for both front and back plates, and are overcoated with a dielectric 4. A photo emissive and/or barrier surface coating 5 may be applied on these dielectrics. The two parts are then sealed together with a seal material 6 at a pre-determined gap between them, typically about 3 to 10 mils and filled via tubulation 8 with an appropriate gas 7, typically neon based. Except for conductor geometry, the details of the dielectric, overcoats, gas fillings, etc. are well known in the art. Reference is made to the U.S. Letters Patents cited hereinbefore. External connections are provided to each of the *y* conductors and to the *x* conductors P, C and T and *x* conductor groups V1, V2 and V3. Gaseous discharges 12 occur at *x* and *y* conductor cross-points to form information illustrated in FIG. 1C and with split *y* conductors 13 in FIG. 1D.

Figure 1B:
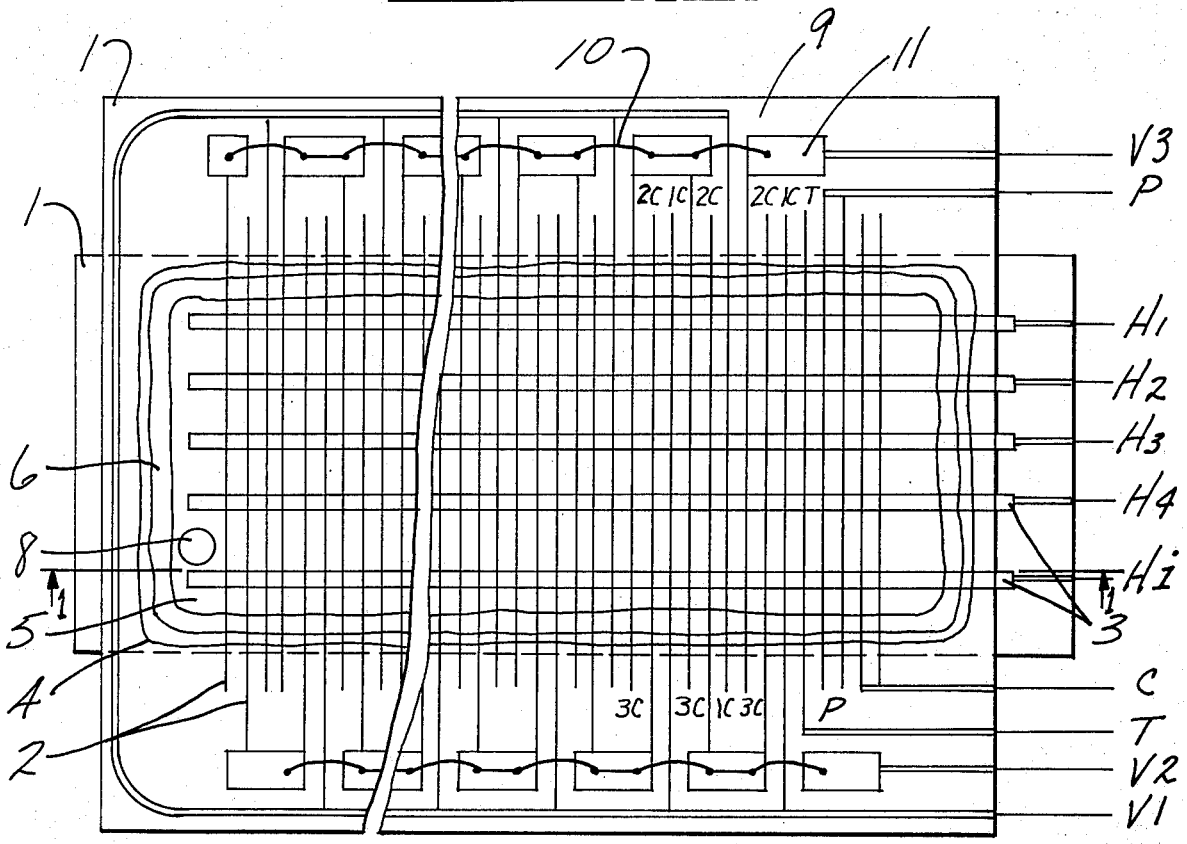
FIG. 1B is a plan view of a gaseous discharge display/memory panel illustrating an array of column electrodes grouped for shifting the "on" discharge sites along the row electrodes according to this invention.

In order to properly interconnect the V1, V2, and V3 conductor groups, a cross-over network or system is utilized. This could be done external to the panel, or on the substrate with several possible patterns. One such pattern is illustrated in FIG. 1B where a cross-over conductor buss 9 connects pads 11 which are connected to two x-conductors, and which are prevented from contacting neighboring conductors by insulator 10 which may be air, dielectric glass, or other suitable material. Alternatively, the "cross-over" could be done by a clip on connector such that panels can be adapted to this type of operation.

In FIGS. 2A, 2B, 2C, and 2D, there is illustrated the wave forms (or voltage trains) for the x and y conductors of an A.C. gas discharge display/memory panel.

More particularly, for the *x* axis conductor C, there is illustrated the waveform 14 which is applied to at least one conditioning *x* conductor C, typically positioned in or at the perimeter of the display area of the panel. There is also illustrated the waveforms 15–19 for the Voltages applied to at least one pilot conductor P, at least one transfer conductor T, and a series of viewing conductors V1, V2, and V3.

Along any *y* axes conductor $H_i$, there can be applied any one of the waveforms 20, 21, 22 represented by D (data input), S (shift), or M (maintain).

Figure 2A:
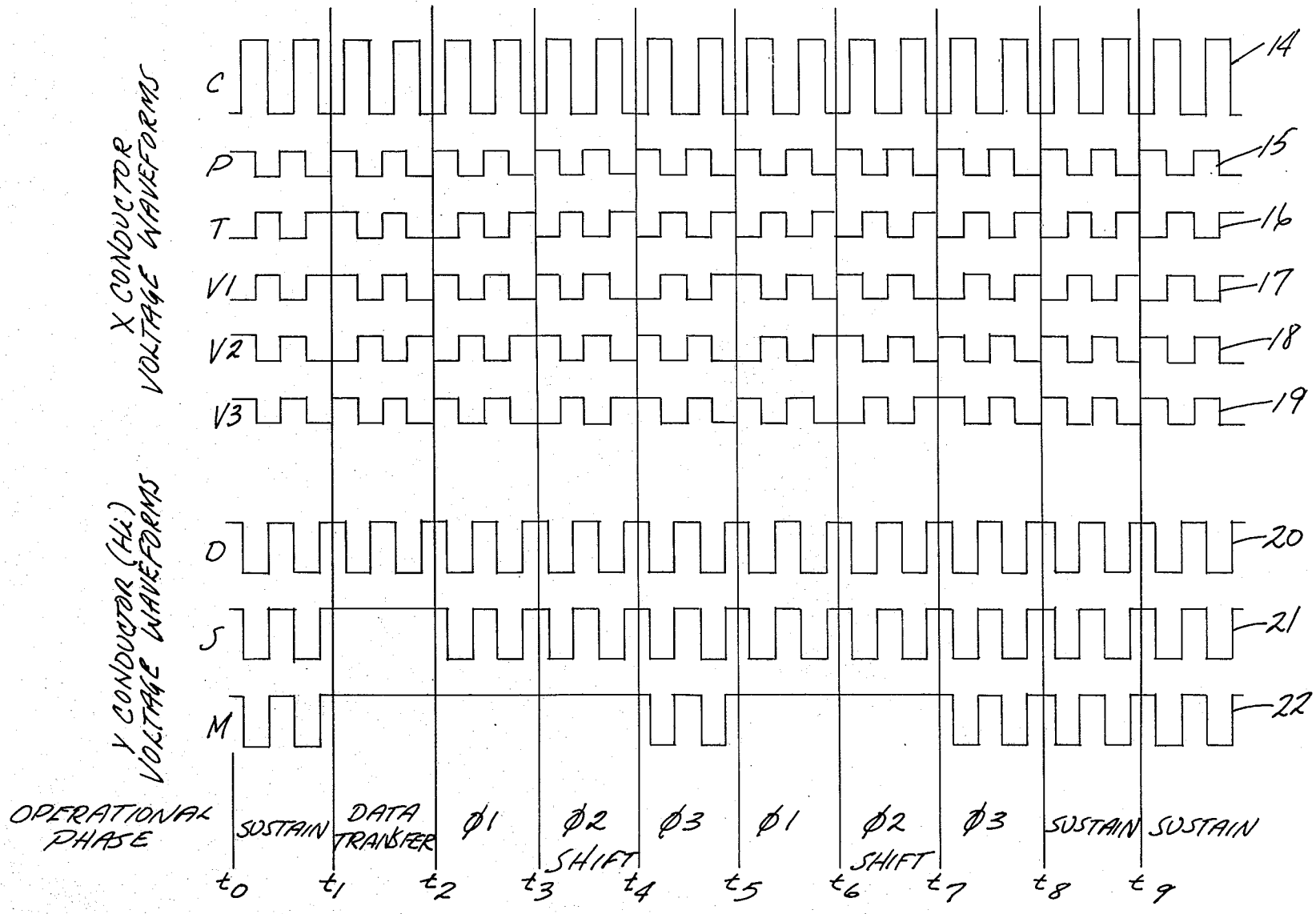
FIG. 2A is a plot of various voltage waveforms against a time base as applied to the row and column electrodes of the devices of FIGS. 1A through 1D including for the column electrodes, a conditioning electrode waveform, a pilot electrode waveform, a transfer electrode waveform, and three groups of display conductors between which discharges can be transferred, and for the row electrodes, a data imput waveform, a data shift waveform and a maintain waveform.
Figure 2B:
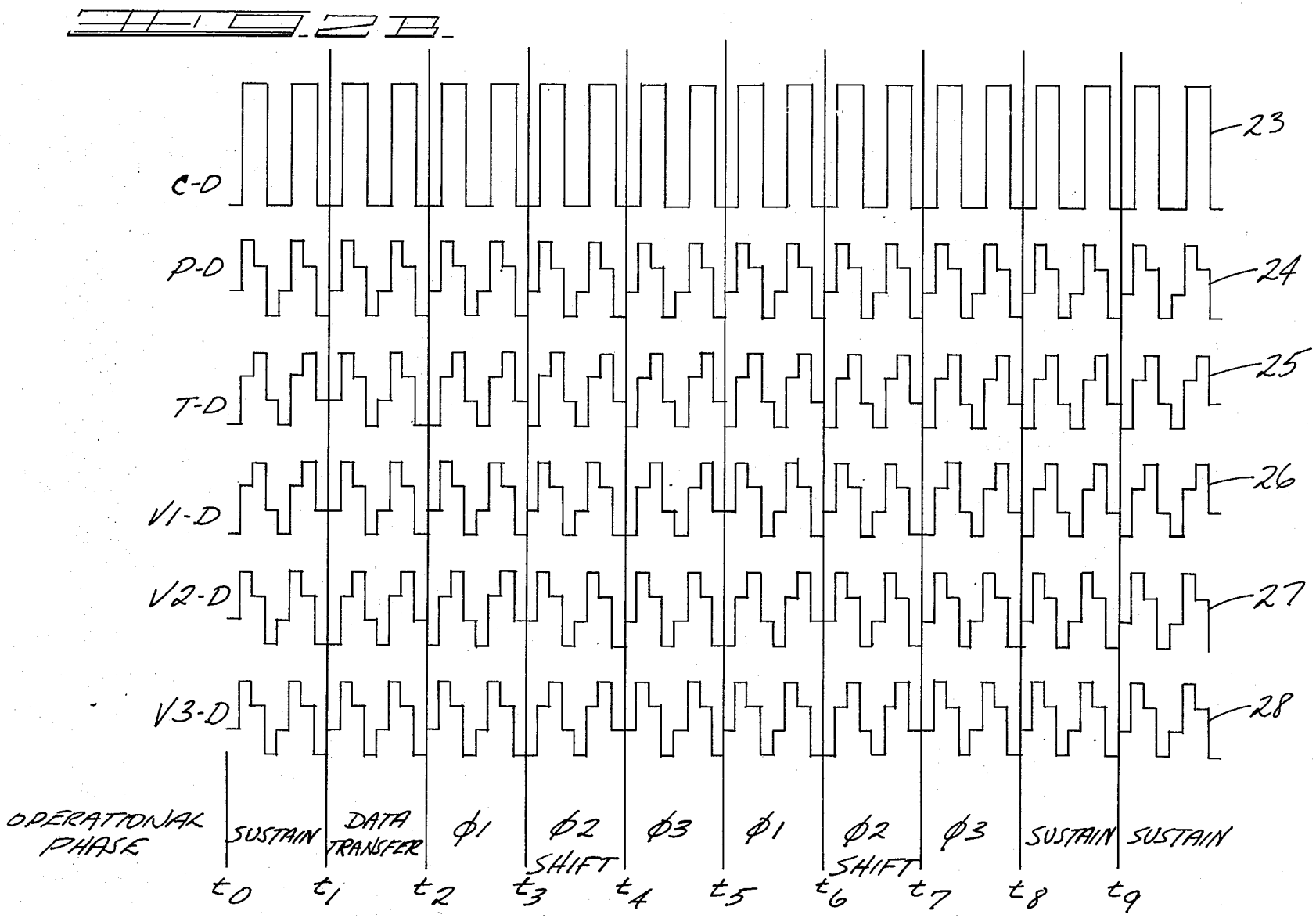
FIG. 2B illustrates the waveforms for the algebraic differences between the column electrode waveforms and the data imput waveform to the row electrodes of FIG. 2A.
Figure 2D:
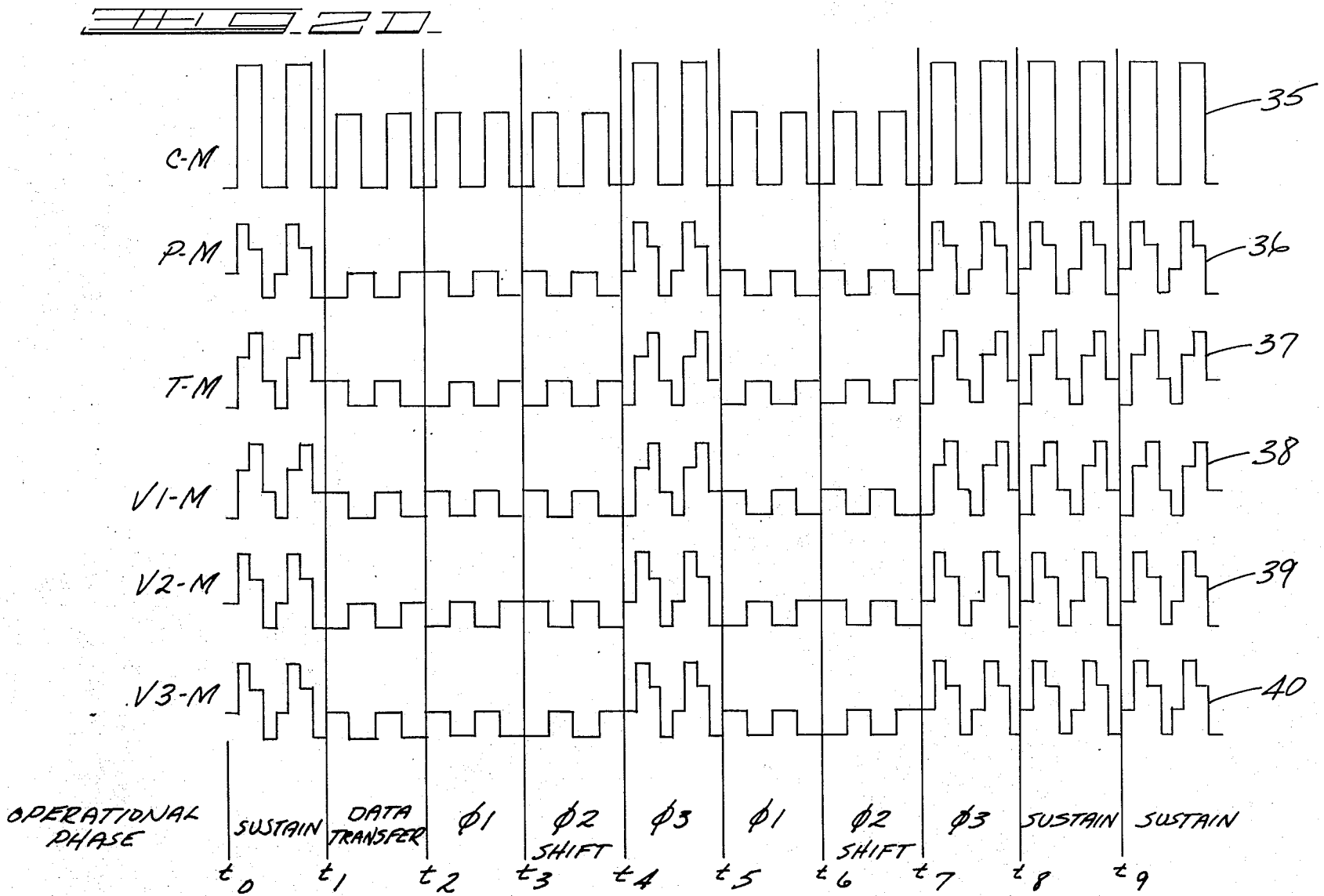
FIG. 2D illustrates the waveforms for the algebraic differences between the column electrode waveforms and the maintain waveform to the row electrodes of FIG. 2A.

FIG. 2B illustrates algebraic differences between each x conductor and any y conductor to which the voltage waveform D is applied. Thus the notation C–D represents the waveform 23 which is the difference between the waveform C applied along an x electrode (or conductor) and the waveform D applied along an opposing y electrode. Likewise, P–D represents the waveform 24 created by the algebraic difference between a P waveform applied to an x electrode and a D waveform applied to an opposing y electrode. In the same way, T-D, V1-D, V2-D and V3-D represents the waveforms 25–28 created by the algebraic differences between associated *x* and *y* electrodes. Similarly, FIG. 2C represents the algebraic difference between associated voltage waveforms applied to associated *x* and *y* electrodes, the waveform applied to the x electrode being either C, P, T, V1, V2, or V3 and the waveform applied to the *y* electrode being S. FIG. 2D represents the algebraic difference between associated voltage waveforms, the x electrode waveforms being either C, P, T, V1, V2, or V3 and the waveform applied to the *y* electrode being M.

FIG. 3A and 3B illustrated an alternate set of possible waveforms which can be used in accordance with this invention. The x axis waveforms 41–46 are applied to the axis conductors C, P, T, V1, V2, V3, while the *y* axis conductors $H_i$ have applied to them waveforms 47, 48, or 49, depending on the desired result, i.e. D (data input), S (shift), or M (maintain).

Because of the similarity in construction to those waveforms in FIGS. 2A, 2B, 2C, and 2D, only a few of the combined waveforms are shown. Thus the waveforms 50–55 in FIG. 3B illustrate the *x* axis minus the *y* axis waveforms 41–49 in FIG. 3A in the same manner that the waveforms 29–34 in FIG. 2C illustrate the *x* axis minus *y* axis waveforms 14–22 in FIG. 2A.

Figure 4:
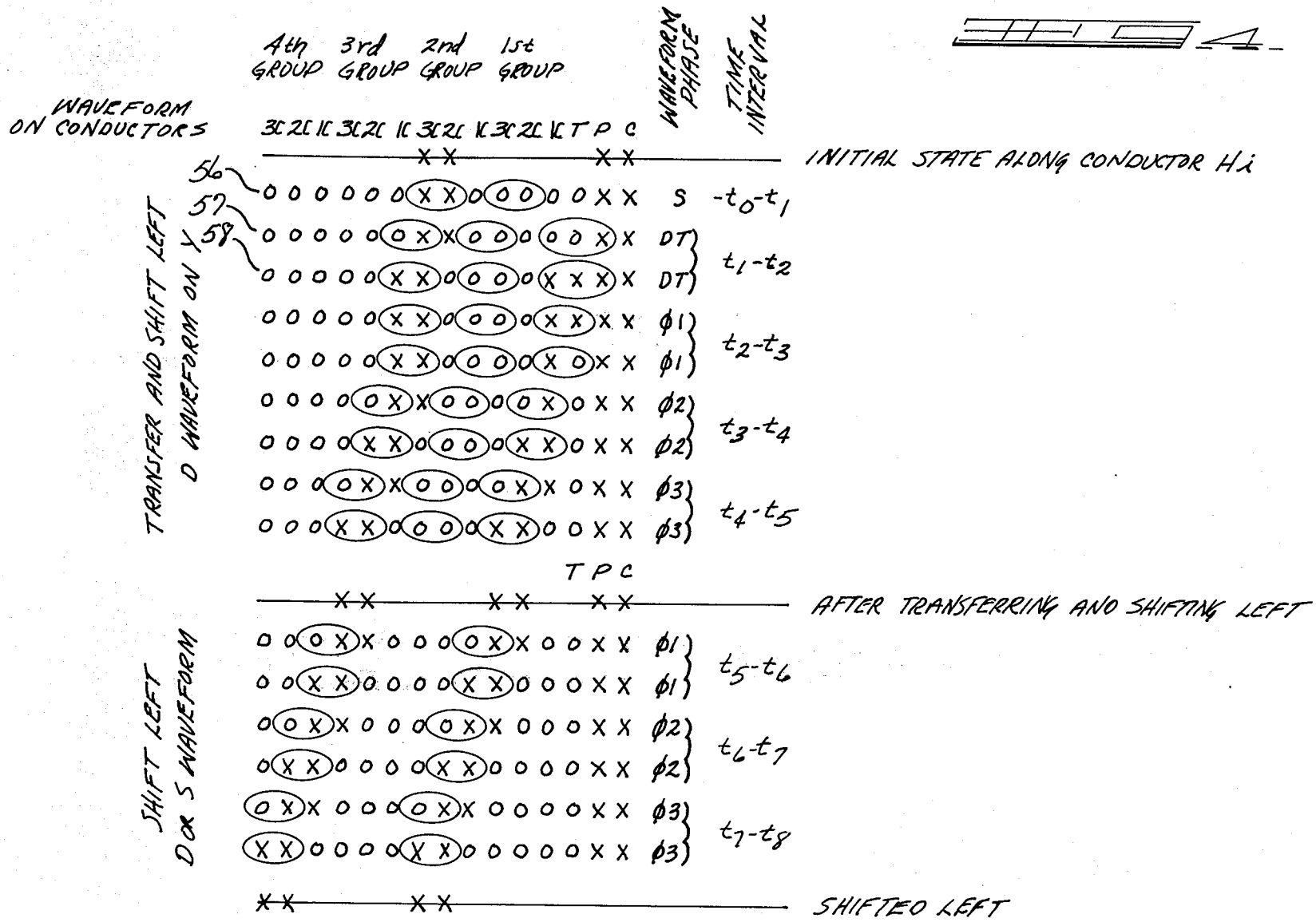
FIG. 4 is a table of cell discharge status keyed to waveforms of FIGS. 2A through 2D.
Figure 5A:
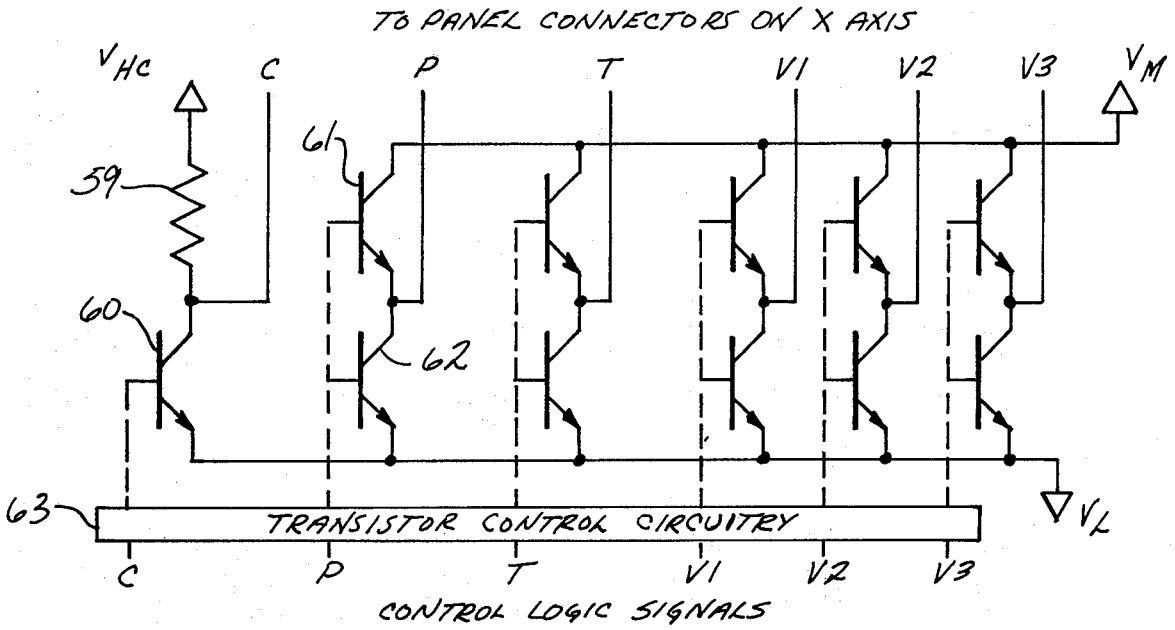
Figure 5B:
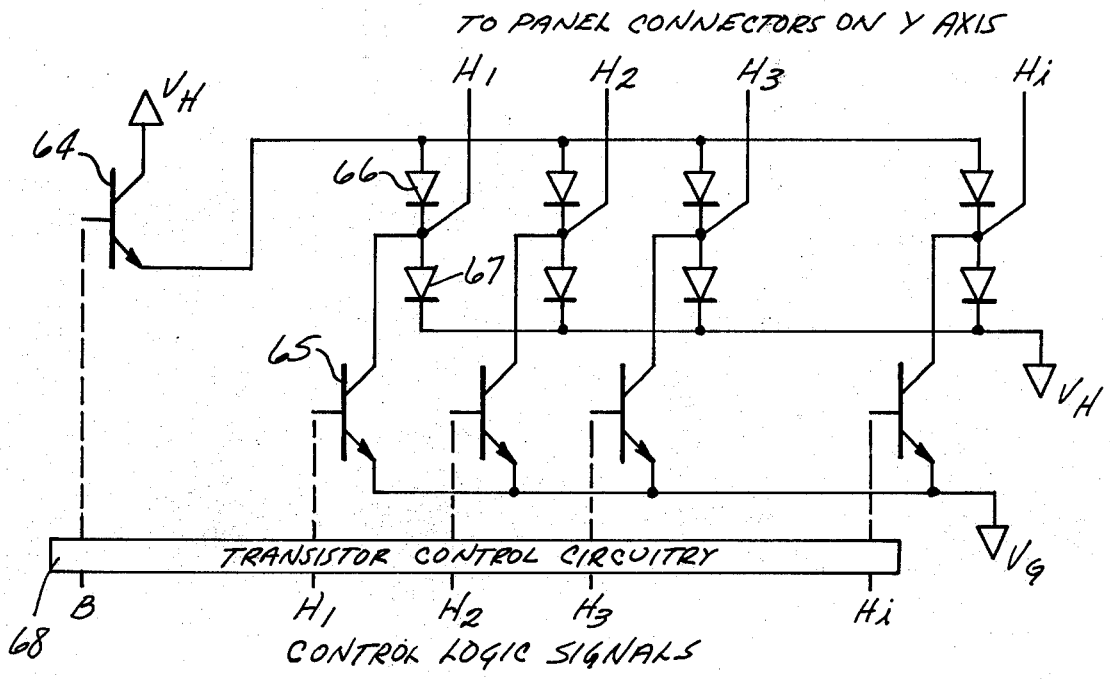
Figure 9:
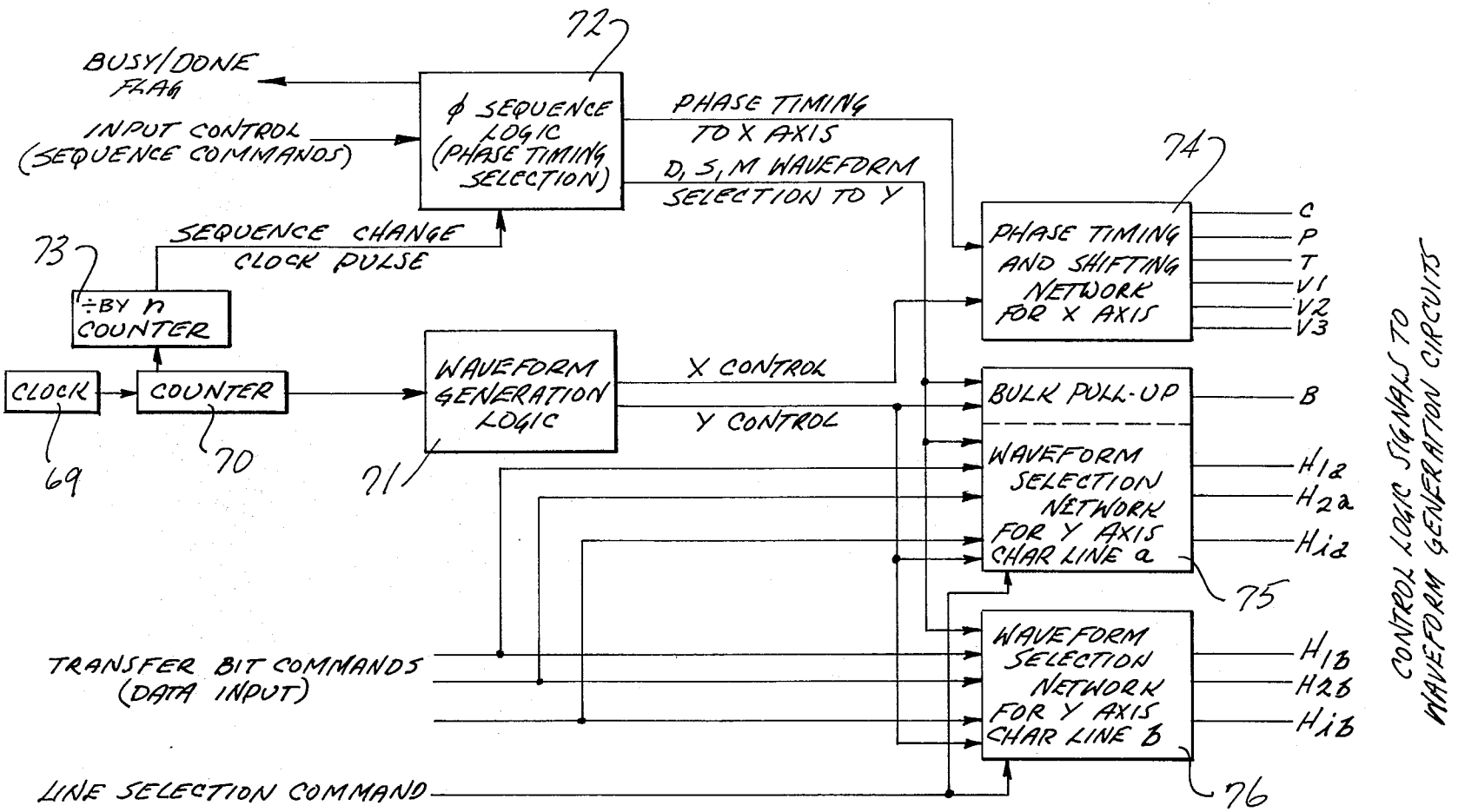

FIG. 4 is a table of discharge cell status and discharge logic element with identification keyed to the waveforms to be used as an aid in further understanding this invention.

Figure 5:
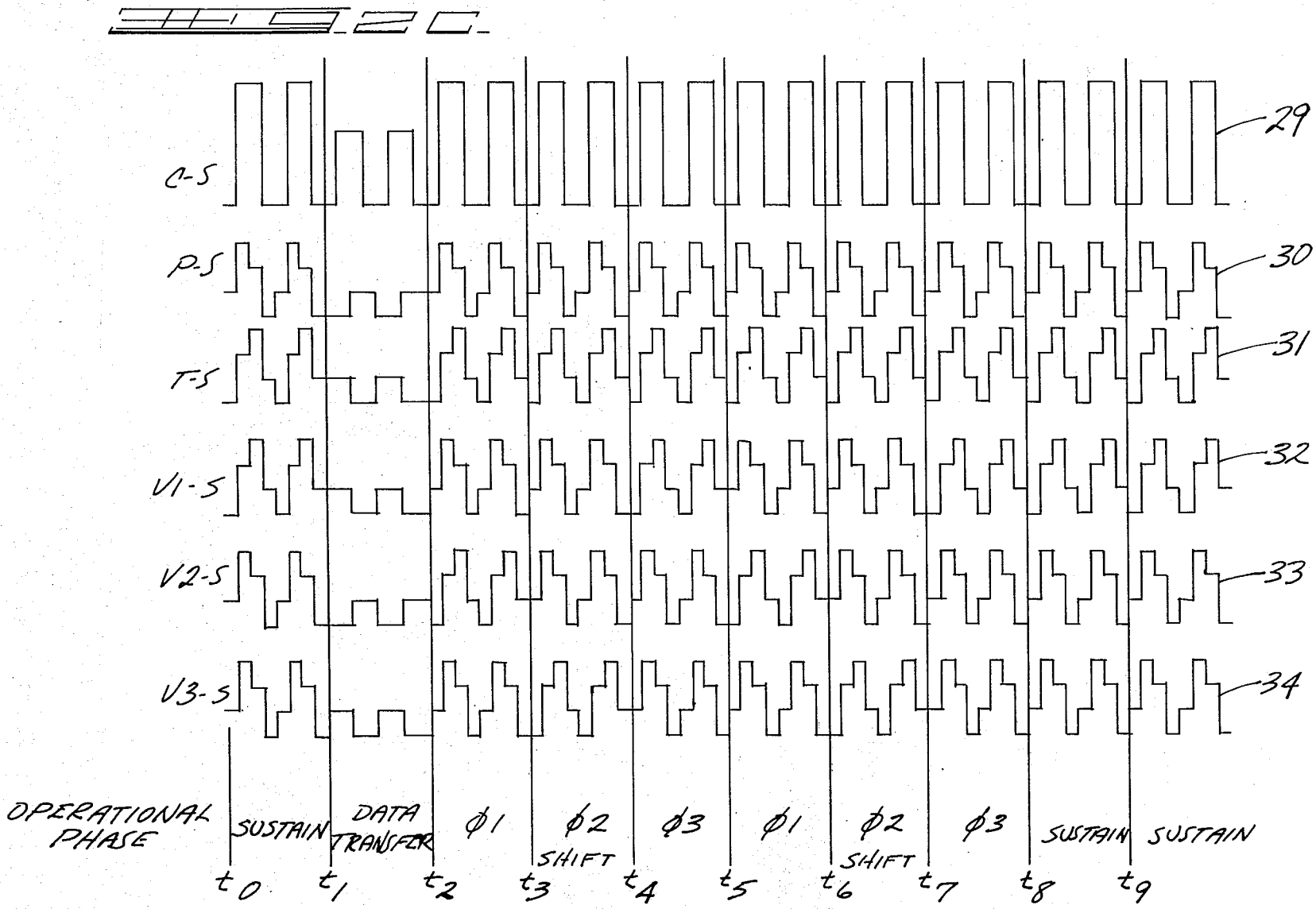
FIG. 5A and 5B are schematic circuit diagrams of the pull-up and pull-down switching means providing the waveforms of FIGS. 2A through 3B.
Figure 5A:
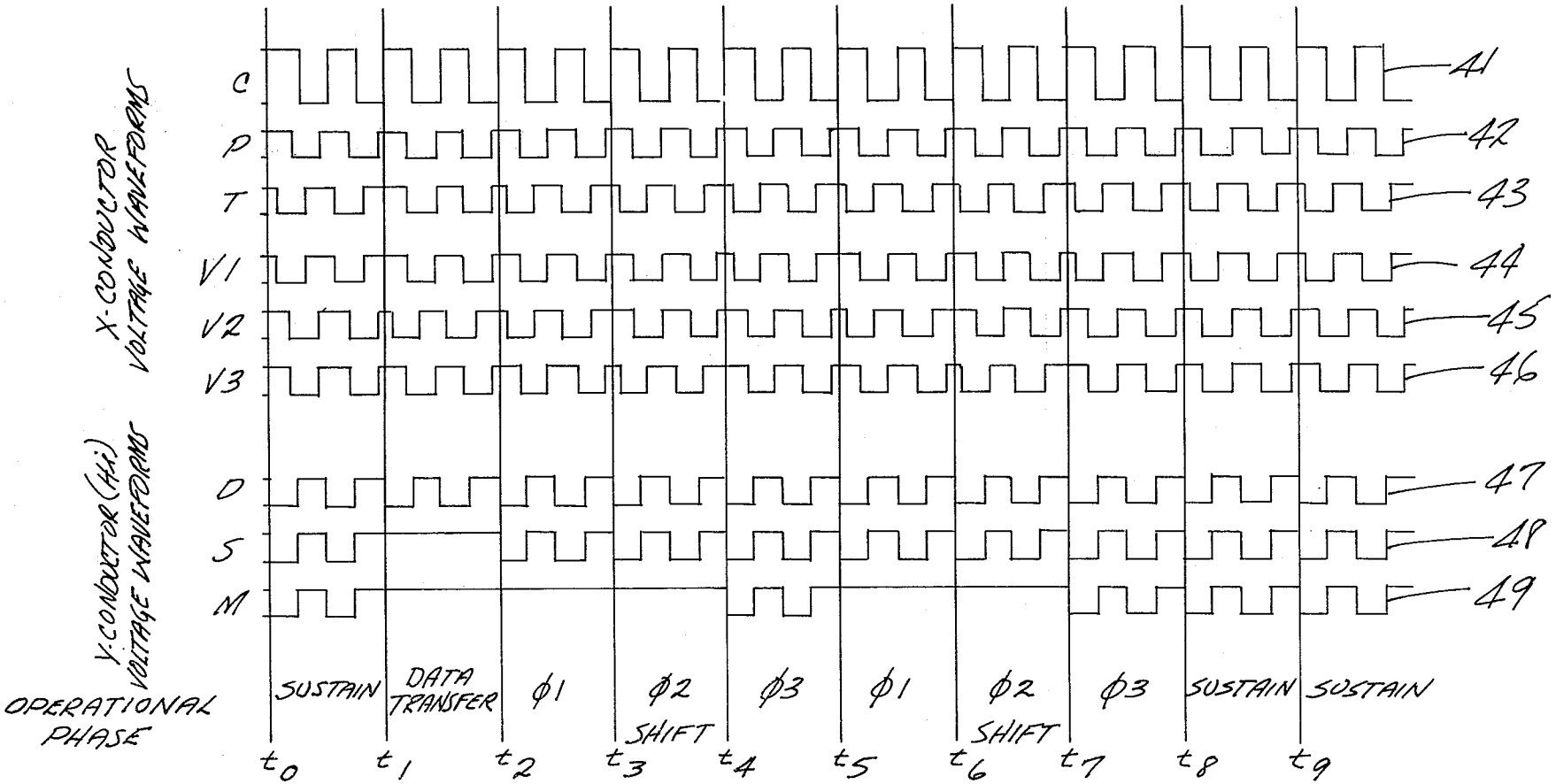
Figure 5B:
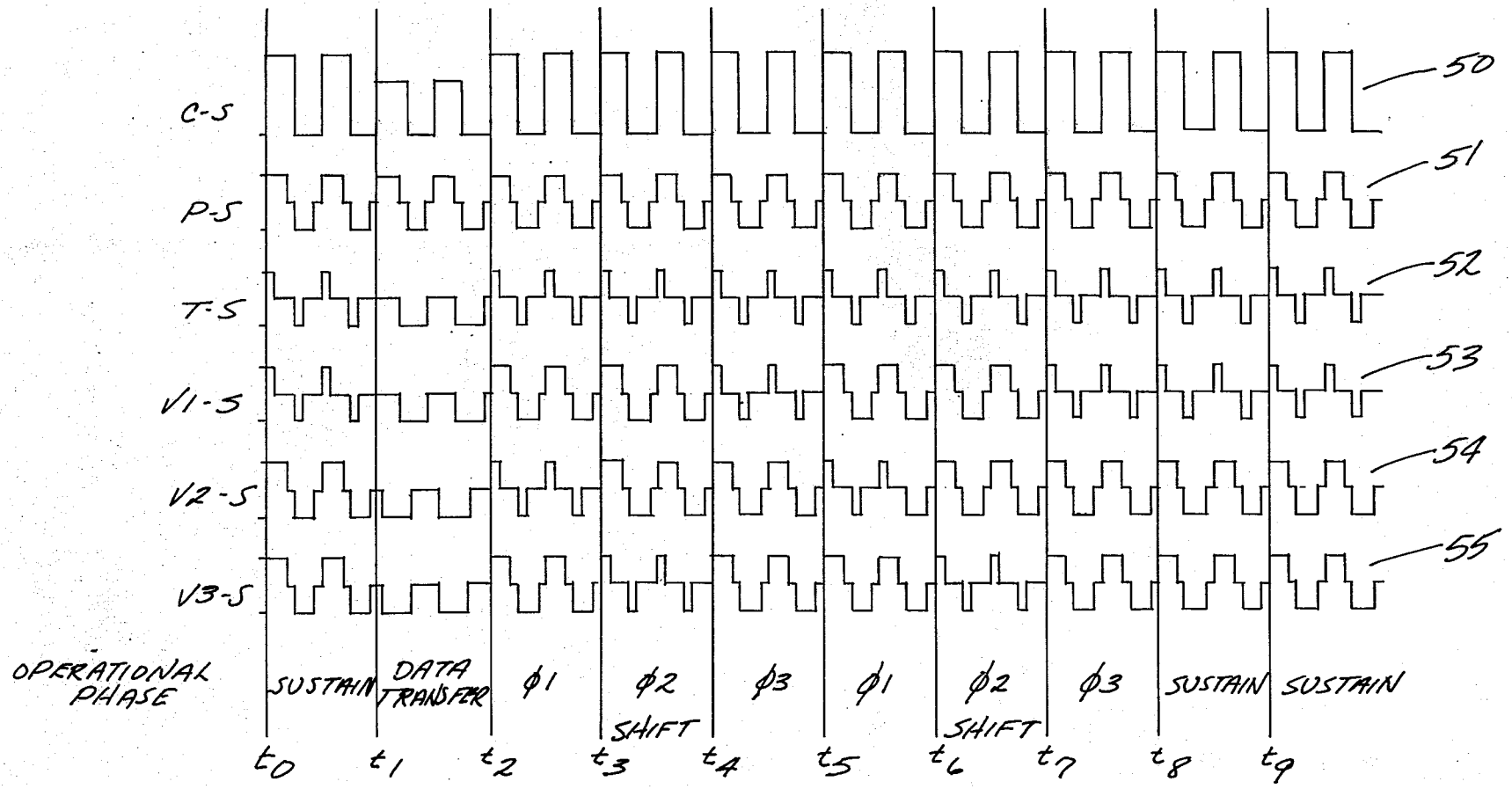

FIGS. 5A and 5B are schematic of electronic circuits which may be used to generate the waveforms used in accordance with this invention.

FIG. 6 is a flow chart of the logic control functions which may be used in this invention to provide control signals for the circuitry in FIG. 5.

Figure 7:
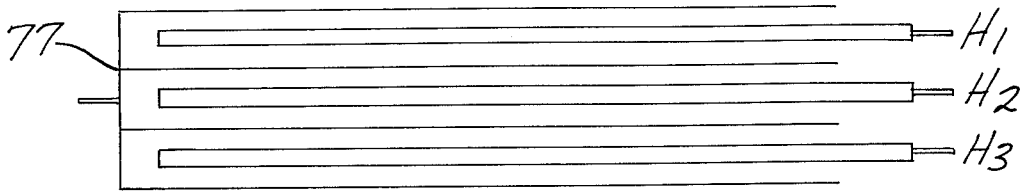
FIG. 7 is a plan view of a row electrode array for a display/memory panel having reduced interelectrode capacitance.

FIG. 7 illustrates a geometry for the *y* axis electrodes used to decrease capacitive coupling between the addressable conductors $H_i$ by introducing another conductor array 77.

Figure 8:
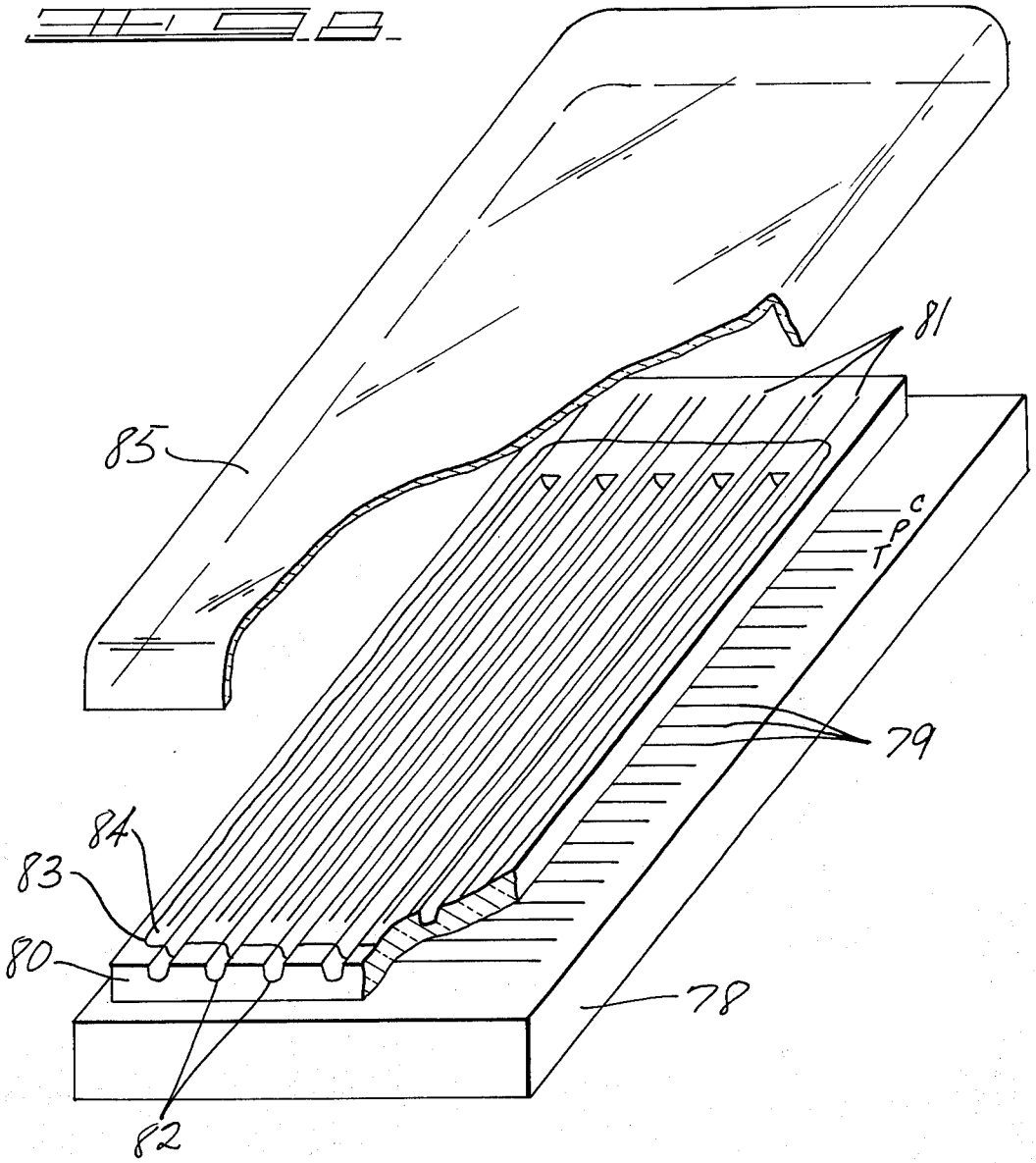
FIG. 8 is an exploded isometric view of a monolithic display/memory panel according to this invention.

FIG. 8 illustrates an alternate panel geometry which may be used in accordance with this invention. This panel is constructed monolithically on a single substrate 78 to which is applied the *x* conductor arrays 79 and support dielectric 80. Depressions, grooves, channels, or holes 82 may be formed in the support dielectric 80 or the equivalent geometry accomplished by a building up technique of several dielectric layers. The *y* axis conductors 81 are then applied and covered with an isolation dielectric 83. A dielectric overcoat material 84 may also be applied over the dielectric 83. Finally, a cover plate is sealed in place and the volume between structure and cover plate is filled with an ionizable gas. Cross-over networks as described in FIG. 1 may be a part of this structure. Reference is made to my issued monolithic panel patent, U.S. Pat. No. 3,787,106, which has already been incorporated herein by reference.

The basic technique utilized by this invention to shift information can be described as follows:

Assume that one is sustaining, in the usual manner of sustaining a display/memory panel, on pairs of electrodes 2 and 3, with the appropriate waveform component on the *x* axes and with the appropriate component waveform on the *y* axes. This is the condition during the "sustain" or 03 operational phase or mode in FIGS. 2 and 3. For "on" state cells a discharge will normally be occurring at every half cycle at the V2 and V3 *x* electrodes and the opposing *y* electrode. The resultant waveforms will be referred to as a sustaining waveform. On the V1 *x* electrode there is applied a waveform out of phase with the waveforms on the V2 and V3 electrodes, typically by 180° which is combined with the waveform on the *y* electrodes to form an erase waveform as shown in the sustain operating mode of FIG. 2B for waveform V1-D. In order to move the information which is contained in two V2, V3-Y discharge cells to a neighboring V2, V3-Y electrode pair, the following sequence of operations is performed. Simultaneously there is applied an erase waveform to the cell of the V2 electrode and a sustaining waveform to the cell of the V1 electrode, as shown typically in FIG. 2 by shifting the x axis waveform for V1 180° in phase so that it is now in phase with the V3 electrode. This is the condition during the 01 operational mode in FIGS. 2 and 3. At this point in time, due to the proximity of the discharges beneath the V3 *x* electrode, the discharge will spread and cause a discharge at its neighboring V1 electrode; there is at this point in time a discharge beneath the V3 and V1 *x* electrodes, but no discharge beneath the V2 electrode. This is my so-called discharge logic technique described in my copending U.S. patent applications Ser. Nos. 372,730, filed June 22, 1973; 372,541, filed June 22, 1973; now U.S. Pat. No. 3,846,656 which issued Nov. 15, 1974 and 372,542, filed June 22, 1973; all incorporated herein by reference. Next the erase waveform is applied to the cell of the V3 electrode while simultaneously applying a sustaining waveform to the cell of the V2 electrode, as by shifting their *x* axis waveforms 180° in phase. This is the condition during the 02 operational mode in FIGS. 2 and 3. Now, because of the aforementioned discharge spreading, the discharge will transfer from the still sustaining V1 electrode to the V2 electrode and light will be admitted from beneath the V1 and V2 electrodes. Next, during the 03 operational mode an erase waveform is applied to the cell of the V1 electrode while the sustaining waveform is applied to the cell of the V3 electrode, typically by shifting the x axis waveforms applied to electrodes V1 and V3 in phase by 180°. Thus, we have again a sustaining waveform on V2 and V3 electrodes and an erase waveform on the V1 electrodes with the discharges occurring beneath the V2 and V3 electrodes. However, these V2 and V3 electrodes are displaced three electrodes from the initial V2 and V3 electrodes. This process is repeated to shift information any number of resolution spots which is defined by a pair of V2 and V3 electrodes.

If no discharge had been occurring at the initial V2, V3 electrodes it can be seen that no discharge spreading can take place during the 3 operational phase shifts and thus after the 3 mode or operational phase shifts, the neighboring V2, V3 electrodes would also be in the "off" or non-discharge state.

To summarize there has been described how one can shift the information contained at the junction of V2 and V3 *x* electrodes and a *y* electrode to a neighboring set of V2 and V3 electrodes along the same *y* electrode. Furthermore, one could easily shift information in the opposite direction by reversing the sequence of the operational phase shifts. Note that this has been done by utilizing only two types of voltage waveforms applied across the panel. The first is a sustaining waveform and the second will be called an erase waveform. In this invention these waveforms are constructed from the *x* and *y* voltage waveform components by changing the phase of the *x* axes voltage waveform.

In one illustration, FIGS. 2A–2D, this phase shift is 180° with a greater magnitude voltage on the y axis conductors to form a resultant erase waveform which has an erase voltage level erase pulse preceding each sustain level voltage pulse. In another example, that of FIGS. *3a* and *3b*, the phase shift is between 0°–180°, typically about 90°, to provide a pulse width which is shortened and acts to erase an on cell by permitting its wall voltage to be discharged to the neutral wall voltage level of the cell and stabilize at that level before a further transition of the voltage across the cell to its opposite polarity. With the second technique, the same voltage magnitude may be used on each electrode axis.

In order to initially input information into the display panel a pilot P electrode(s) is provided. A set of pilot cells are formed at the junction of the pilot electrode(s) and *y* lines which are always in the on state. Between the pilot cells the first number V1*x* electrode is positioned a transfer T electrode, the purpose of the T electrode is to transfer information from the P electrodes to the first V1 cell located beneath the V1 *x* electrode and the selected *y* electrode. A further purpose of the transfer electrode is to prevent the transfer of "on" information along an unselected *y* electrode. In considering the data transfer along a selected *y* electrode (refer to FIGS. 2A to 3B during the data transfer operational phase). It will be noted that at the data transfer time, there is applied sustaining waveforms on *x* electrodes V1 and V3 and the erase waveform on electrode V2. Also during this interval there is applied sustaining waveforms to the P and T electrodes. Because of the aforementioned discharge spreading, "on" state information is transferred to the intersection of the T and selected *y* electrodes and then to the first V1 *x* electrode.

During this time the T electrode is in phase and acts like a V3 electrode. A shift sequence is then initiated such that information is shifted in the same manner as described above until the on information resides beneath the first V2 and V3 electrodes along the selected *y* electrode. Note that any information already entered into this *y* line will be shifted over to the next V2 and V3 electrodes.

Beneath a shifted line designated S during the time that information is transferred along the data line D, the voltage *y* axis waveform on the shifted line is held stationary. The *x* axis waveform voltage magnitude is not sufficient to cause a discharge; consequently no data is transferred from the P line to the T line to the first V1 line during the shift cycles. However, the waveform on S line is identical to the waveform on the D line except during the Data Transfer time, $t_1$ to $t_2$, and hence any previously entered data is shifted in the same manner. One can summarize data entry as the following: to enter and shift a logic "1" data bit, one uses a D waveform and to enter an "0" data bit one uses an S waveform.

The third type of waveform is designated M for maintain. The voltage of this waveform is such to hold information stationary on selected *y* electrodes. This is accomplished by holding the M waveforms stationary during the first two shift cycles, that is the 0 1 and 0 2 operational phases, and sustaining only when *x* electrodes V2 and V3 are sustained. No information is transferred along the *y* electrode in this mode. Information is retained due to the memory properties of the device.

In order to assure that pilot cells along x electrode P are in the on state and to initially put them in the on state at system turn on, a conditioning electrode C is provided. A large voltage amplitude is applied to this electrode and associated discharge cells are operated in the non-memory mode. Typically, current limiting means is provided for the conditioning cells. It is the function of the conditioning cells to initiate and maintain the pilot cells in the "on" state. This is achieved by assuring that the conditioning cells are discharging by applying high voltage pulses and causing the discharges to spread to the pilot cells due to their physical proximity.

Another way to understand the operation of this device is to view it as a sequence of moving logical elements. Reference is made to FIG. 4. At any given instant when there is applied to two or more adjacent conductors in the first (vertical) conductor array potential sources essentially in phase, and an opposing cooperating conductor in the second conductor array has applied to it a potential source, the combination of said potential sources constituting a sustaining waveform, the behavior of the discharge sequences between the crosspoints of said conductors is such that if there exists a stable discharging sequence beneath one crosspoint, there will result stable discharging sequences beneath the other said crosspoints in the immediately following time interval. Functionally, this performs the logic OR operation and has been described in my previously mentioned discharge logic patent applications. On those adjacent conductors of the first conductor array which are not essentially in phase, the waveform which results from the cooperation of the voltage source connected to above mentioned conductor in the second (horizontal) conductor array is such to prohibit a stable discharging sequence (that is, cause it to erase by deleting wall charges) beneath the crosspoints.

In the employment of this invention these logic OR elements are caused to move sequentially along the display by selectively changing the phase relationships of the voltage sources; but changing them such that at least two said voltage sources are in phase, the matrix crosspoints of the at least two adjacent conductors connected to the at least two voltage sources essentially in phase which define the location of the logic OR element. This can be more fully understood by studying the discharge status table in FIG. 4 along with the waveform and timing diagrams in FIGS. *2a–3b.*

Figure 1C:
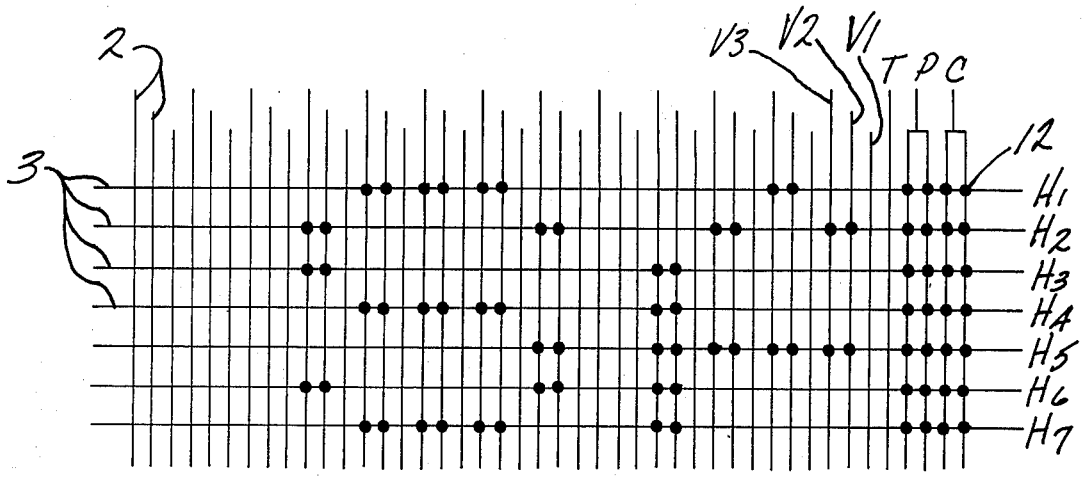
FIG. 1C is an electrode matrix pattern of electrodes according to FIG. 1B with the other structural details omitted and "on" paired discharge sites represented by dots at the electrode cross-point projections normal to the general plane of the panel.
Figure 1D:
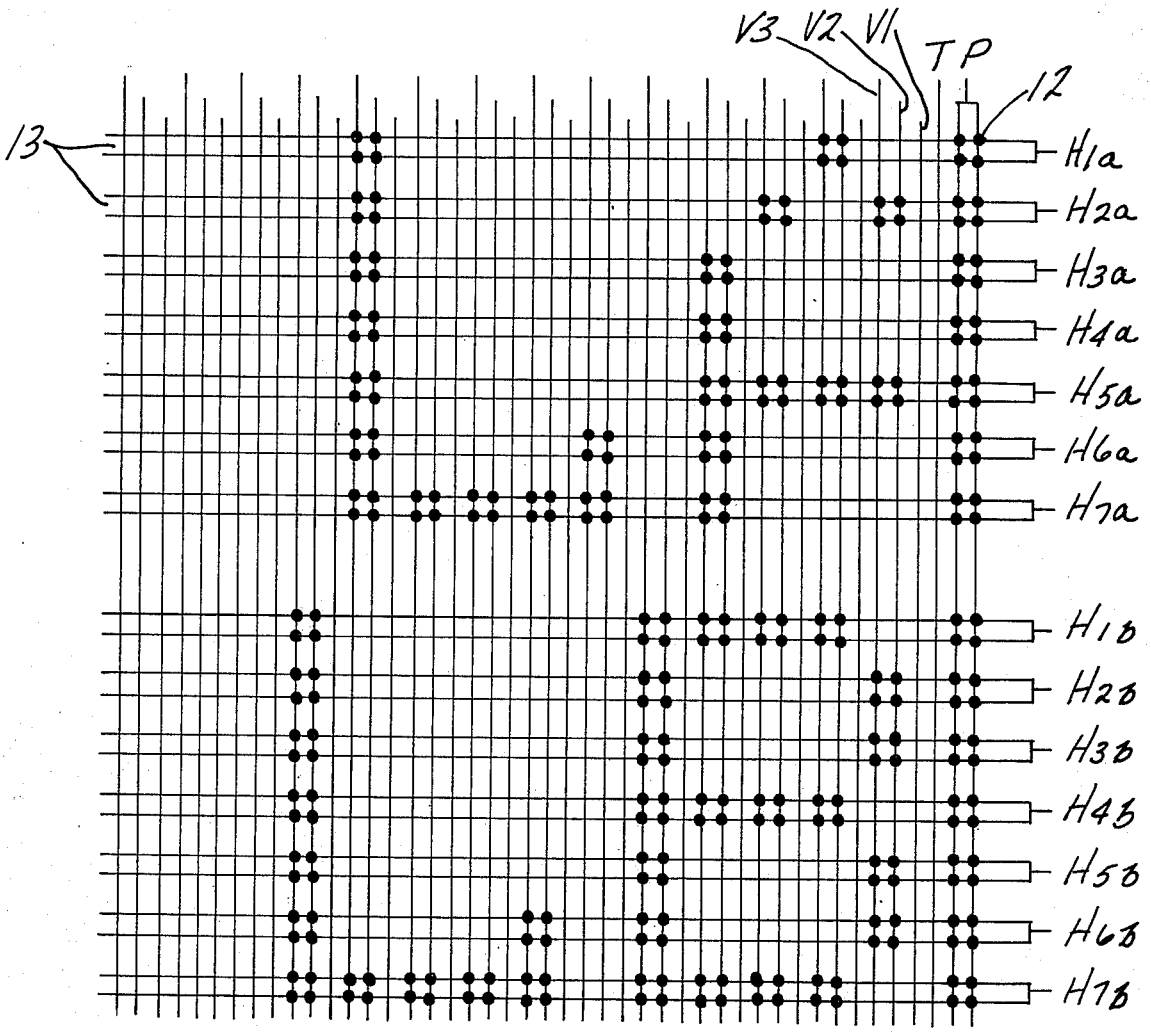
FIG. 1D is an electrode matrix pattern of the same presentation as FIG. 1C showing dual electrodes in the row electrode array to provide quadruple "on" discharge sites.

In FIG. 4 one of the possible phase sequences is illustrated which first transfers information into the display along a horizontal ($y$) electrode $H_i$ having a D type waveform applied to it, then shifts the information left on the display device as illustrated in FIGS. 1*c* and 1*d*, and then left again without entering and transferring any new information. A discharging state is indicated by an $x$ and an erased state is indicated by an O. An elongated circle around at least two discharge sites serves to indicate the logic units during waveform operational phases, defined by the corresponding waveforms illustrated in FIGS. 2A–3B during the time intervals between the times $t_i$ keyed in FIGS. 2A–3B. The waveform modes or operational phases are indicated by the letters S (sustain). DT (Data Transfer), 01 (mode 1), 02 (mode 2), and 03 (mode 3) the last of which is identical to the S mode. Thus, referring to line 57 of FIG. 4 for example, at the beginning of the DT mode starting just after time *t*hd i, there is a discharging cell beneath the vertical ($x$ axis) P conductor along the horizontal ($y$ axis) $H_i$ conductor, having a D type waveform indicated in FIGS. 2A–3B and also beneath the V2 and V3 vertical electrodes on the second group of V1, V2, and V3 electrodes. At the end of this time interval just before time $t_2$, indicated by line 58 of FIG. 4, there will be a discharge beneath also the T vertical electrode and the V1 vertical electrode on the first group, since this is a logic element with 3 adjacent electrodes having sustaining waveforms essentially in phase, and also the V1 vertical conductor in the third group (adjacent to the previously discharging cell defined by the crosspoint beneath the V3 conductor in the 2nd group). Note that the cell beneath the V2 conductor in the second group is not discharging, since the waveform on the V2 conductor is out of phase with that applied to the V1 and V3 conductors and combines with the D wave form applied to the $H_i$ horizontal conductor to provide an erase waveform which erased said cell during the time interval $t_1$–$t_2$. In the proceeding modes 01, 02, 03, etc., it should now be clear how the logic elements move about the display upon manipulation of the waveform phases in accordance with FIGS. 2A–3B, thus causing the movement of discharging pairs of cells which constitute display information.

It should be noted that each mode S, DT, 01, 02, and/or 03 may contain any number $n$ of sustain (or erase) cycles which can be selected to control the rate of movement of information about the display or to achieve the greatest operating margins by allowing optimum stabilization of the discharge sequences which may take place in some instances after several sustainer cycles. The operational modes S, DT, 01, 02, and 03 should not be confused with the phase timing referred to by the description "essentially in phase" or "out of phase", etc.

To provide the waveforms illustrated in FIGS. 2A–3B, an electric switching circuit diagrammed in FIGS. 5A and 5B may be used in conjunction with sequencing and timing logic, an example of which is diagrammed in FIG. 6. Consider first the generation of waveforms P, T, V1, V2, V3 as illustrated in FIGS. 2A–3B. These can be produced by switching between the two voltage levels $V_M$ and $V_L$, the potential difference typically being on the order of 60 to 80 volts for the waveforms in FIG. 2, and 100–120 volts for waveforms in FIG. 3, by appropriately and alternately turning on and off transistors 61 and 62. The conditioning waveform can be produced by switching between two voltage levels $V_{HC}$ and $V_L$. A transistor 60 is used switch to the level $V_L$; however, since it is not necessary to operate the cells associated with the C onductor in a "memory mode", a resistor 59 is used to switch to the voltage level $V_{HC}$ and also as a current limiting device to diminish the intensity of the discharges. Typically, the potential difference between $V_{HC}$ and $V_{LC}$ is 200–240 volts. Transistor control circuitry 63 provides proper current voltage and current biasing for controlling the transistors and can be readily assembled by anyone knowledgeable in the art. This is all the circuitry necessary for the vertical ($x$ axis) conductor array.

The waveforms on the horizontal ($y$ axis) conductors $H_i$ can similarly be produced by switching between two voltage levels $V_H$ and $V_G$. Refer to FIG. 5B. In this case, however, since examination of the waveforms shows all $H_i$ to be pulled to the $V_H$ level at the same time instants, a bulk pull-up switch transistor 64 may be used. During time intervals when various $H_i$ are pulled to the $V_G$ level, the transistor switch 64 is turned off. The various $H_i$ are isolated from each other by diodes 66 and are pulled to the level $V_G$ by selectively turning on transistors 65. Again, control circuitry 68 provides proper current and voltage biasing necessary to turn transistor switches 64 and 65 on and off. The voltage levels on conductors $H_i$ not connected to $V_G$ via an on 65 transistor at a time when others may be and while transistor 64 is off, are maintained at their previous voltage level $V_H$ due to charge stored on the inherent associated capacitance; or alternatively additional capacitance elements may be added for this purpose. One way to assure such capacitance elements, and also to inhibit capacitive coupling between conductors $H_i$, is to provide an additional set of conductors, positioned between said conductors $H_i$, and connected to another potential source, for example ground. This is illustrated in FIG. 7. Also at certain times during operation, the voltage on the $H_i$ tends to raise above the value $V_H$; thus diode 67 is provided as a voltage clamp.

The timing control signals P, T, V1, V2, V3 B, and the $H_i$'s which are applied to the above-mentioned transistors 61, 62, 64, 65 are generated by an electronic logic system diagrammed in FIG. 6.

The basic timing is set by a clock 69 which is illustrated as free-running but could also be externally controlled. The clock runs a counter 70 which is used to select positions on a Read Only Memory (ROM) 71 which outputs waveform generation logic in the form of *x* and *y* control signals which determines the possible turn-on and off signals responsible for the waveform phase relationships illustrated in FIG. 2A and/or 3A. The repetition frequency of these signals is that of one sustainer cycle, typically on the order of 10 – 100 KHz. A divide by n counter 73 is provided to determine the number of basic sustain cycles for each mode or operational phase, which may be sustain, Data transfer, 01, 02, or 03. At the end of *n* basic sustain cycles, a sequence change clock pulse is produced which increments a 0 Sequence Logic circuit 72, which may also be a ROM. This logic circuit outputs the mode or phase timing for the current mode or operational phase. This circuit typically allows several operational phase sequences which can be selected by the user thru the input control lines (sequence commands). It also outputs a Busy/Done flag or pulse to indicate to the user (which may be a computer) that an operational phase sequence has been completed and he may select another. Some examples of mode or operational phase sequences might be:

| | | |
|---|---|---|
| Sustain | = | S (Sustain) |
| Transfer and Shift Left | = | DT (Data Transfer) then 01, 02, 03 |
| Shift Left only | = | 01, 02, 03 |
| Shift Right | = | 03, 02, 01 |

The mode or operational phase timing for the *x* axis from the 0 Sequence Logic 72 and *x* control signals from the Waveform Generation Logic 71 are combined and/or shifted in phase by a gating network 74 which provides the control logic signals C, P, T, V1, V2, and V3, used to control the appropriate transistors in FIG. 5A.

The D, S, or M (possible Y waveforms) control signals for y from the 0 Sequence Logic 72 and the y control signals from the waveform generation logic 71 are combined in Waveform Selection Network 75. Also input to this gating network are user Data Input Transfer Bit Commands, by which the user can determine whether discharges are to be transferred (a logic 1) or not (a logic 0) along a selected *y* line (the $H_i$). If the display is character oriented and there is more than one character line, an additional Waveform Selection Network 76 is provided and further user control lines labeled Line Selection Command. These gating networks 75 and 76 provide the control logic signals B and signals to all the $H_i$ for the circuit in FIG. 5B.

Further logical details of this system can easily be provided by one skilled in the art of Logic design. Thus, the logic diagram in FIG. 6 together with the circuit diagram in FIGS. 5A and 5B illustrate how one can construct the electronic means of producing the potential waveforms in FIGS. 2A – 3B which drive the display device.

It should also be noted that several extensions to this basic invention could be constructed. For example, particularly in the case of waveforms in FIGS. 3A, 3B which may have identical voltage magnitudes on both *x* and *y* electrode axis, the roles of the *x* and *y* axis could be exchanged, and thus, with the appropriate conductor patterns in the panel, information transfer could be effected in either axis, that is, in either *x* or *y* directions. One use of such a scheme would be to shift in a line of characters along the *x* axis, and then move the entire line up along the *y* axis – thus effecting the visual appearance of a shift and scroll. Another extension would be the use of this invention in conjunction with current or light detecting devices, particularly positioned at the extreme end of the *x* conductor array. In this manner the device may be used as a shift register memory. Only one current-read-out circuit (with an associated conductor, not shown) or light detector would be needed as it could be shared by several lines which can shift or transfer information across the detector selectively in time.

I claim:

1. A gas discharge display panel and associated electronic means for applying potential signals to the panel, the gas discharge display panel being characterized by an ionizable gaseous medium and having a pair of opposing conductor arrays transversely oriented so as to define a matrix of gas discharge cells within the gaseous medium in the vicinity of a matrix of conductor crosspoints, the conductors of at least one array being insulated from the gaseous medium by at least one dielectric member, the associated electronic means comprising at least first, second and third potential sources, at least two of the sources having waveforms which are in phase with respect to each other and which are out of phase with respect to the waveform of at least one of the remaining sources at any selected instant of time, means connecting a first set of spaced conductors in one of the arrays to the first potential source, means connecting a second set of spaced conductors in said one of the arrays to the second potential source, each conductor of the second set being respectively adjacent to a conductor in the first set of conductors in a one-to-one relationship, means connecting a third set of spaced conductors in said one of the arrays to the third potential source, each conductor of the third set being respectively adjacent to a conductor in the second set of conductors in a one-to-one relationship such that each conductor of the second set is intermediate to both a conductor in the first set and a conductor in the third set, at least one further potential source and means connecting said further potential source to at least one conductor on the other opposing conductor array, the combination of the further potential source and each of at least two of the other potential sources constituting a first composite potential waveform a. which causes discharge sequences to occur at adjacent discharge cells near the crosspoint vicinity of adjacent conductors when at least one cell has been in a discharge state in an immediately preceding time interval, or b. which causes no discharge sequence to occur at adjacent discharge cells near the crosspoint vicinity of adjacent conductors when neither cell has been in a discharge state in an immediately preceding time interval in either instance (a) or (b), each said adjacent conductor of said one array being connected to potential sources having waveforms which are substantially in phase, at least one other conductor of said one array connected to at least one potential source having its waveform out of phase with the waveforms of said in phase potential sources of said adjacent conductors of said one array, the combination of the further potential source and each out of phase potential source constituting a second composite waveform which prohibits the continuance of a discharge at a cell near the crosspoint vicinity of a conductor connected to the out of phase potential source.

2. The invention defined in claim 1 wherein the at least one further potential source is at a zero amplitude.

3. The invention defined in claim 1 wherein each conductor in at least one of said conductor arrays is constituted by a pair of spaced apart conductive lines.

4. The invention defined in claim 3 wherein said at least one conductor array is said other of said conductor arrays.

5. The invention defined in claim 1 including means for changing the phase relationships of the waveforms of the first, second, and third potential sources so that any pair of said potential sources can be selected to have waveforms which are substantially in phase, and means for selecting the sequence of said pairs of potential sources having waveforms which are substantially in phase such that the resulting said first and second composite voltage waveforms cause information to be shifted laterally in said panel in a selected direction.

6. The invention defined in claim 1 wherein said gas display panel includes at least one pilot conductor and at least one information transferring conductor for entering data into the gas discharge matrix, said information transferring conductor being disposed adjacent and parallel to one lateral end conductor of said first, second or third sets of spaced conductors of said one of said arrays, the points of crossings of said at least one information transfer conductor with the conductors in the other of said arrays constituting information transfer sites to said panel, the points of crossings of said at least one pilot conductor with the conductors in the other of said arrays being contiguous to said information transfer sites and forming therewith an operational element adapted to enter information to said information transfer sites in response to the selective application of a potential waveform at an information transfer conductor and a potential waveform to one or more selected conductors in said other array to form composite waveforms at transfer sites at the points of crossing of said one or more selected conductors and said information transfer conductor.

7. The invention of claim 1 wherein there is provided means for selectively detecting and recording information within the panel gas discharge matrix.

8. The invention of claim 7 wherein the means includes a light sensing device.

9. The invention of claim 7 wherein the means includes at least one further electrode positioned to receive shifted information and current sensing means for detecting the presence of a discharging cell on such electrodes.

10. A gas display panel having a pair of transverse conductor arrays constituting a crossed conductor display matrix non-conductively coupled to a gas discharge medium, at least one pilot conductor and at least one information transferring conductor for entering data into the display area from an edge thereof, disposed adjacent and parallel to one lateral end conductor of one of said arrays, the points of crossings of said at least one information transfer conductor with the conductors in the other of said arrays constituting information transfer sites to said panel, the points of crossings of said at least one pilot conductor with the conductors in the other of said arrays being contiguous to said information transfer sites and forming therewith an operational element adapted to enter information to said information transfer sites in response to the selective application of a potential waveform to an information transfer conductor and a potential waveform to one or more selected conductors in said other array to form composite waveforms at transfer sites at the points of crossing of said one or more selected conductors and said information transfer conductor, and at least one conditioning conductor adjacent and parallel to said pilot conductor and on the opposite side thereof from said at least one information transferring conductor, the points of crossings of said at least one conditioning conductor with the conductors in the other of said arrays constituting conditioning sites providing ionization at initial turn on of said pilot sites, and adapted to have applied thereto a voltage of a greater magnitude than the voltage applied to said pilot and information transferring conductors.

11. In combination with the display panel in claim 10, a signal voltage system comprising at least a first, a second and a third common potential sources, at least two of said sources having waveforms which are in phase with respect to each other and which are out of phase with respect to the waveform of the remaining of said sources at any selected instant of time, means connecting a first set of equally spaced conductors in one of said arrays to said first common potential source, means connecting a second set of equally spaced conductors in said one of said arrays to said second common potential source, each conductor of said second set being adjacent to a respective conductor in said first set of conductors, means connecting a third set of equally spaced conductors in said one of said arrays to said third common potential source, each conductor of said third set being intermediate and equally spaced from the conductors of said first and said second sets of conductors, at least one further potential source and means connecting said further potential source to at least one conductor on said other conductor array, the combination constituting a voltage waveform which causes discharge sequences, constituting display information, to occur in adjacent pairs beneath the conductors connected to common potential sources which are substantially in phase with each other, when at least one of the pair has been in an on state in an immediately preceding time interval.

12. The invention defined in claim 11 including means for changing the phases of the waveforms of the first, second, and third potential sources so that any pair of said potential source waveforms can be selected to be substantially in phase, and means for selecting the sequence of said pairs of potential source waveforms substantially in phase such that the resulting composite voltage waveforms cause information to be shifted laterally in said panel in a selected direction.

13. The invention defined in claim 11 wherein each conductor in at least one of said conductor arrays is constituted by at least a pair of spaced apart conductive lines.

14. The invention defined in claim 13 wherein said at least one conductor array is said other of said conductor arrays.

15. The invention defined in claim 11 including means for inhibiting the pulsating wave train on a selected conductor of the other of said arrays such that the effect of the voltage applied to a selected pair of adjacent sites having on logic elements is insufficient to cause the discharge sequence at the sites while retaining the charge stored at said selected pair of adjacent logic element sites, simultaneously as other logic elements are manipulated.

16. A gas display system having a pair of transverse conductor arrays constituting a crossed conductor display matrix non-conductively coupled to a gas discharge medium, at least one pilot conductor and at least one information transferring conductor, supplied for entering data into the display area, disposed adjacent and parallel to one lateral end conductor of one of said arrays, the points of crossings of said at least one information transfer conductor with the conductors in the other of said arrays constituting the information transfer sites to said panel, at least a first, a second and a third common potential source, means connecting said one lateral end conductor and at least one further selected non-adjacent, spaced conductor parallel to said one lateral end conductor to the first of said common potential sources, means connecting an intermediate one of the conductors in said one of said arrays adjacent said one lateral end conductor and the conductor adjacent said at least one further conductor with said second common potential source and means connecting the remaining of said conductors in said one array with said third common potential source, means for exciting said at least one pilot electrode and said at least one information transfer electrode to enter information to said information transfer sites, one of either said first, second, and third common potential sources being displaced in phase with respect to the others, at least one further potential source and means connecting said further potential source to at least one conductor on said other conductor array, the combination constituting a voltage waveform which causes discharge sequences, consituting display information, to occur in adjacent pairs beneath the conductors connected to common potential sources which are substantially in phase with each other, when at least one of the pair has been in an on state in an immediately preceding time interval.

17. The invention defined in claim 16 including at least one further conductor array, the conductors in said one further array being parallel to the conductors in one of the arrays forming said cross point display matrix and adapted to have applied thereto a potential for establishing isolation.

18. A method of operating a gas discharge display panel having a pair of transverse conductor arrays constituting a cross-point display matrix non-conductively coupled to a gas discharge medium through a pair of thin dielectric charge storage member, comprising generating at least first, second and third common potential, at least two of said potentials being in phase with respect to each other and out of phase with respect to the remaining of said sources at any selected instant of time, each of said common potentials being generated by switching between two voltage levels, applying said first common potential to a first set of equally spaced conductors in one of said arrays, applying said second common potential to a second set of equally spaced conductors in said one of said arrays, each conductor of said second set being adjacent to a respective conductor in said first set of conductors, applying said third common potential to a third set of equally spaced conductors, each conductor of said third set being intermediate and equally spaced from the conductors of said first and said second sets of conductors, generating at least one further potential and applying said further potential to at least one conductor on said other conductor array, the combination constituting display information, to occur in adjacent pairs beneath the conductors connected to the common potential sources which are substantially in phase with each other, when at least one of the pair has been in an on state in an immediately preceding time interval, and causing the voltage on those conductors of said first conductor which are out of phase to combine with the voltage on said second conductor array to prohibit the continuance of a discharge sequence beneath the conductors having said out of phase voltages thereon.

19. The invention defined in claim 18 including the step of substantially simultaneously erasing all information entered to said panel.

20. A method of operating a gaseous discharge data display panel in which a pair of transverse, dielectrically coated conductor arrays form a cross conductor matrix for supplying discharge condition manipulating potentials to discharge sites located by said matrix, comprising:

1. applying to a first conductor in a first array a first pulsed voltage train,
2. applying to the second conductor in said first array a second pulsed voltage train,
3. applying to a third conductor in said first array a third pulsed voltage train which is phase shifted at selected data entry times, 4. applying to a first conductor set in said first array a fourth pulsed voltage train phase displaced with respect to said first pulsed voltage train,
5. applying to a second conductor set in said first array a fifth pulsed voltage train phase displaced with respect to said second pulsed voltage train,
6. applying to a third conductor set in said first array a sixth pulsed voltage train phase displaced with respect to said third pulsed voltage train,
7. selectively applying to selected ones of the conductors in the other of said arrays a seventh pulsed voltage train which is of a magnitude substantially greater than any of said second, third, fourth, fifth or sixth pulsed voltage trains.

21. The invention defined in claim 20 wherein the waveforms applied to said electrodes of said first array which are not in phase are caused to be 180° out of phase.

22. In a gas discharge display panel having a cross conductor matrix constituted by dielectrically coated conductor arrays defining discharge sites in said panel, and means for applying operating potentials to said sites such that a selected number of adjacent ones of said sites constitute an operational logic element for entry of information to said panel, the improvement comprising means for shifting said operational logic element comprising a plurality of discharge sites with information entered thereto to a selected set of sites in said panel.

23. A method of operating a gaseous discharge data display panel in which a pair of transverse, dielectrically coated conductor arrays form a cross conductor matrix for supplying discharge condition manipulating potentials to discharge sites located by said matrix, comprising:

1. applying to a first conductor in a first array a first pulsed voltage train,
2. applying to the second conductor in said first array a second pulsed voltage train,
3. applying to a third conductor in said first array a third pulsed voltage train which is phase shifted at selected data entry times,
4. applying to a first conductor set in said first array a fourth pulsed voltage train phase displaced with respect to said first pulsed voltage train,
5. applying to a second conductor set in said first array a fifth pulsed voltage train phase displaced with respect to said second pulsed voltage train,
6. applying to a third conductor set in said first array a sixth pulsed voltage train phase displaced with respect to said third pulsed voltage train,
7. selectively applying to selected ones of the conductors in the other of said arrays a seventh pulsed voltage train which in combination with one phase displaced voltage train forms a voltage train having pulse widths less than the pulse widths of other voltage trains formed by said combination with said seventh voltage train.

24. The invention of claim 23 wherein the seventh pulsed voltage train is of equal magnitude to the fourth, fifth, and sixth displaced pulse voltage trains.

25. A gas display panel having a pair of transverse conductor arrays constituting a crossed conductor display matrix non-conductively coupled to a gas discharge medium, at least one pilot conductor and at least one information transferring conductor for entering data into the display area from an edge thereof, disposed adjacent and parallel to one lateral end conductor of one of said arrays, the points of crossings of said at least one information transfer conductor with the conductors in the other of said arrays constituting information transfer sites to said panels, the points of crossings of said least one pilot conductor with the conductors in the other of said arrays being contiguous to said information transfer sites and forming therewith an operational element adapted to enter information to said information transfer sites in response to the selective application of a potential waveform to an information transfer conductor and a potential waveform to one or more selected conductors in said other array to form composite waveforms at transfer sites at the points of crossing of said one or more selected conductors and said information transfer conductor, said conductor arrays being contiguous to opposite surfaces of a common dielectric member.

26. The invention defined in claim 25 wherein said dielectric member has formed in one surface thereof a plurality of grooves, each said groove having a longitudinal axis transverse to the conductor array contiguous to the opposite surface thereof.

27. The invention defined in claim 26 including means forming an electrostatic shield between adjacent conductors in one of said arrays.

28. The invention defined in claim 27 wherein said means forming an electrostatic shield is constituted by a coplanar array of conductors interleaved with the conductors of the array having said electrostatic shield.

* * * * *